US009711875B2

(12) United States Patent
Ooba

(10) Patent No.: US 9,711,875 B2
(45) Date of Patent: Jul. 18, 2017

(54) TERMINAL AND ALUMINUM WIRE CONNECTION STRUCTURE OF TERMINAL

(71) Applicant: SUMITOMO WIRING SYSTEMS, LTD., Mie (JP)

(72) Inventor: Takuya Ooba, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 15/110,499

(22) PCT Filed: Jan. 14, 2015

(86) PCT No.: PCT/JP2015/050720

§ 371 (c)(1),
(2) Date: Jul. 8, 2016

(87) PCT Pub. No.: WO2015/115174

PCT Pub. Date: Aug. 6, 2015

(65) Prior Publication Data

US 2016/0336662 A1 Nov. 17, 2016

(30) Foreign Application Priority Data

Jan. 28, 2014 (JP) ..... 2014-013136

(51) Int. Cl.
*H01R 9/24* (2006.01)
*H01R 11/12* (2006.01)
(Continued)

(52) U.S. Cl.
CPC ..... *H01R 11/12* (2013.01); *H01R 4/029* (2013.01); *H01R 4/184* (2013.01); *H01R 4/34* (2013.01);
(Continued)

(58) Field of Classification Search
CPC ..... H01R 13/03
(Continued)

(56) References Cited

U.S. PATENT DOCUMENTS 3,665,881 A * 5/1972 Koch ..... H01H 11/04 29/874
3,777,051 A * 12/1973 Ziegler, Jr. ..... H01R 4/62 174/84 C
(Continued)

FOREIGN PATENT DOCUMENTS

JP 2003-249281 9/2003
JP 2009-277674 11/2009
(Continued)

OTHER PUBLICATIONS

Search Report issued by Japan patent office in Japan Patent Application No. PCT/JP2015/050720, dated Mar. 3, 2015.

*Primary Examiner* — Phuong Dinh
(74) *Attorney, Agent, or Firm* — Greenblum & Bernstein, P.L.C

(57) ABSTRACT

A bolt-fastened terminal connects to a wire that includes an aluminum core wire of an aluminum-based metal. The terminal includes a wire connection configured by a copper-based metal material and continuous with an electric contact that includes a bolt hole, the wire connection being welded and electrically connected to the aluminum core wire. A surface of the wire connection is coated with a first metal such as nickel and a surface of the electric contact is coated with a second metal such as tin. The first metal and the second metal, which are configured by different metals, are selected from metals between hydrogen and aluminum, aluminum having a negative electric potential with reference to the electric potential of hydrogen and a high ionization tendency, and the second metal is a metal having a smaller
(Continued)

negative electric potential and lower ionization tendency than the first metal.

5 Claims, 2 Drawing Sheets

(51) Int. Cl.

| | |
|---|---|
| ***H01R 4/02*** | (2006.01) |
| ***H01R 4/62*** | (2006.01) |
| ***H01R 43/02*** | (2006.01) |
| ***H01R 13/03*** | (2006.01) |
| ***H01R 4/34*** | (2006.01) |
| *H01R 4/18* | (2006.01) |

(52) U.S. Cl.
CPC ..... *H01R 4/625* (2013.01); *H01R 13/03* (2013.01); *H01R 43/0207* (2013.01); *H01R 4/187* (2013.01)

(58) Field of Classification Search
USPC ..... 439/886, 883, 887, 891
See application file for complete search history.

(56) References Cited

U.S. PATENT DOCUMENTS

| | | | | |
|---|---|---|---|---|
| 4,650,274 | A * | 3/1987 | Schmid | H01R 4/64 439/801 |
| 7,494,388 | B2 * | 2/2009 | Kakuta | H01R 4/185 439/877 |
| 8,571,008 | B2 * | 10/2013 | Kim | H04J 3/0667 370/350 |
| 9,136,617 | B2 * | 9/2015 | Sakae | H01M 2/206 |
| 2013/0231013 | A1 | 9/2013 | Sato et al. | |

FOREIGN PATENT DOCUMENTS

| | | |
|---|---|---|
| JP | 2011-165618 | 8/2011 |
| JP | 2013-020862 | 1/2013 |
| JP | 2013-165008 | 8/2013 |
| WO | 2012/046762 | 4/2012 |

* cited by examiner

TERMINAL AND ALUMINUM WIRE CONNECTION STRUCTURE OF TERMINAL

FIELD OF THE INVENTION

The present invention relates to a terminal and an aluminum wire connection structure of the terminal. In particular, the present invention is favorably used as a terminal connecting an aluminum wire having an aluminum-based metal core wire to a terminal formed by working a copper-based metal plate, the terminal joining with a mated conductive member by tightening a bolt.

BACKGROUND OF THE INVENTION

In recent years, there has been a tendency to use aluminum wire as a wire routed in an automobile instead of the commonly used copper wire, aluminum wire having the advantages of being lightweight and low-cost. The aluminum wire includes aluminum-based metal strands twisted into a core wire, which is coated by an insulating coating configured by an insulating resin. Meanwhile, a terminal is connected to the wire in order to electrically connect to a busbar, terminal, grounding vehicle body panel, or the like configured by a conductive metal material. The terminal is formed by a copper-based metal due to the copper-based metal having good conductivity and highly reliable electrical connection.

Accordingly, the aluminum-based metal core wire (hereafter referred to as an aluminum core wire) of the aluminum wire is brought into contact with and connected to a copper-based metal terminal. However, when the aluminum core wire and the copper-based terminal are brought into contact, contact is established between the dissimilar metals Al and Cu. Contact between these dissimilar metals increases the likelihood of corrosion, and the advance of corrosion is particularly facilitated when an area of contact between the dissimilar metals is subjected to a snow melting agent, battery electrolyte, rainwater, and wash water.

In response to the above-noted issue, an aluminum wire terminal 100 shown in FIG. 7 has been proposed in Japanese Patent Laid-open Publication No. 2013-20862. In the terminal 100, a surface of a copper-based metal terminal is covered by an aluminum layer, and when core wire barrels 101 of the terminal 100 are swaged and crimped onto an aluminum core wire of an aluminum wire and the aluminum wire and terminal 100 are brought into contact, contact is established between similar metals, preventing corrosion from occurring.

RELATED ART

Patent Literature

Patent Literature 1: Japanese Patent Laid-open Publication No. 2013-20862

SUMMARY OF THE INVENTION

Problems to be Solved by the Invention

In cases where the crimped terminal 100 of Patent Literature 1, shown in FIG. 7, is a terminal in which an electric contact 102 matingly engages with a mated terminal (a female terminal in FIG. 7), when the mated terminal is also a terminal plated with an aluminum layer there is engagement between similar metals and thus no risk of corrosion.

However, in some cases a terminal provided with an aluminum layer in order to connect with an aluminum wire may, as shown in FIG. 8, include a bolt hole 152 in an electric contact 151, and a bolt 160 passes through the bolt hole 152 to form a bolt-fastened terminal 150 fastening to a mated conductive member 165 with the bolt 160 and a nut (not shown in the drawing). In such a case, the bolt 160 is a copper-based metal or has tin plated on a copper-based metal surface. Therefore, there is contact between the copper or tin on the surface of the bolt and the aluminum layer on the terminal 150, establishing contact between dissimilar metals, and corrosion is more likely to occur on a surface where the bolt and the terminal are in contact.

Moreover, in cases where the aluminum wire is a thick wire in which the core wire has a cross-sectional surface area of at least 8 $mm^2$, in order to increase reliability of an electrical connection between the aluminum core wire and the terminal and reliably prevent moisture infiltration, the aluminum core wire and the terminal are connected by ultrasonic welding. In such a case, when both surfaces where the aluminum core wire and the terminal are in contact are aluminum, there may be difficulty in welding using ultrasonic welding because aluminum has a high melting point. Also, when resistance welding is performed instead of ultrasonic welding, heat deterioration may occur in the insulating coating.

The present invention is conceived in light of the above-noted issues, and provides a bolt-fastened terminal connected to an aluminum wire, the terminal preventing contact between dissimilar metals at an aluminum core wire of the aluminum wire and the terminal as well as contact between dissimilar metals at a bolt and the terminal, inhibiting corrosion.

Means for Solving the Problems

In order to resolve the above-noted issues, the present invention provides a terminal which is a bolt-fastened terminal connecting to a wire that includes an aluminum core wire of an aluminum-based metal. The terminal includes a wire connection configured by a copper-based metal material and continuous with an electric contact that includes a bolt hole, the wire connection being welded and electrically connected to the aluminum core wire. A surface of the electric contact and a surface of the wire connection are coated with a first metal and a surface of the first metal of the electric contact is coated with a second metal. The first metal and the second metal, which are configured by different metals, are selected from metals between hydrogen and aluminum, aluminum having a negative electric potential with reference to the electric potential of hydrogen and a high ionization tendency, and the second metal is a metal having a smaller negative electric potential value and lower ion ionization tendency than the first metal.

The first metal may be selected from Zn, Cr, Fe, and Ni while the second metal may be selected from Cr, Fe, Ni, and Sn. The first metal and the second metal may be an alloy having a selected metal as a primary component. "Primary component" indicates a component making up a greater than 50 mass % proportion of a total mass.

A relationship between the electric potential and ionization tendency of a metal is such that as the electric potential goes "− electric potential→0→+ electric potential," the ionization tendency decreases. The electric potential of aluminum is −1.662 V, the electric potential of nickel is −0.257 V, the electric potential of tin is −0.138 V, the electric potential of hydrogen is 0 V, and the electric potential of copper is +0.342 V. Because corrosion is likely to occur in areas of contact between dissimilar metals when a potential difference is large, in view of corrosion prevention, metals having decreased electric potential are selected as the metals in contact with each other.

The wire connection of the terminal contacts the aluminum core wire, whereas the electric contact contacts the copper-based metal bolt. The potential difference between aluminum and copper is large, and therefore when the wire connection and electric contact are plated with the same metal, the potential difference with one of the aluminum wire and the bolt increases, increasing the likelihood of corrosion on the side having the increased potential difference. Thus, in the present invention, as described above, the first metal plated onto and coating the wire connection, which is in contact with the aluminum core wire, is a metal having a decreased potential difference with aluminum and comparatively high ionization tendency. In the electric contact of the terminal, which is in contact with the bolt, the second metal is plated on top of and coats the surface of the first metal plating, and the second metal is differentiated from the first metal. The second metal is a metal having a low ionization tendency near that of the copper of the bolt, and is a metal having a lower ionization tendency than the first metal.

Specifically, the electric contact and the wire connection in contact with the aluminum core wire are preferably coated with nickel plating (in the following, this includes nickel alloy plating), and the electric contact in contact with the bolt, which is tin plated (in the following, this includes tin alloy plating), is preferably coated with tin plating on the surface of the nickel plating. In this way, base plating is preferably performed by nickel plating the entire terminal, then the electric contact is top plated with tin plating, and the wire connection is coated with a nickel coating layer whereas the bolt-fastened electric contact is coated with a tin coating layer.

The copper-based metal bolt is the same metal as the copper-based metal terminal. Although this is preferred as not causing corrosion at an area of contact in an unplated state, plating is ordinarily performed in order to prevent oxidation of the bolt. The plating is tin plating, which reduces the potential difference with the copper-based terminal. Accordingly, the electric contact of the terminal in contact with the tin plated bolt preferably has tin plating to establish contact between similar metals.

When the entire terminal is tin plated and the wire connection in contact with the aluminum core wire is also tin plated, the tin may melt during welding of the aluminum core wire and the terminal, tin having a dissolution temperature of 232° C. Therefore, an oxide film of the aluminum core wire cannot be broken. When the oxide film of the aluminum core wire is not broken, the electric connection with the terminal is not adequately formed. Thus, using tin plating as the plating of the wire connection, which is welded to the aluminum core wire, is inadequate. Nickel plating is provided on the wire connection, nickel plating having a small potential difference with tin and a high dissolution temperature (1453° C.). Meanwhile, when the entire terminal is only nickel plated and the electric contact, which is in contact with the tin plated bolt, is also nickel plated, tin and nickel establish contact between dissimilar metals, leading to a potential for corrosion. Therefore, as described above, tin plating is preferred.

As described above, the terminal according to the present invention is a bolt-fastened terminal having a bolt hole in the electric contact. Preferably, the wire connection in contact with the aluminum core wire has a base plate surface of the wire connection, which is continuous with the base plate of the electric contact, as a core wire welding portion, and includes an insulating coating barrel at a rear end of the core wire welding portion, the insulating coating barrel being swaged and fixated to an insulating coating of the wire. Also, core wire barrels may project on two width direction sides of the core wire welding portion of the electric contact, and after the aluminum core wire is welded to the core wire welding portion, a crimping device may swage and crimp the core wire barrels together with the insulating coating barrel.

Moreover, ribs may be provided to the core wire welding portion at two locations separated by an interval in a front/back direction, the ribs extending over the entire width direction, and strands of the aluminum core wire may be welded with no gap onto the ribs in the two locations.

Furthermore, the present invention provides an aluminum wire connection structure of the terminal in which the bolt-fastened terminal is connected to the aluminum wire, which is routed in a vehicle and includes the aluminum core wire. The aluminum wire is the thick wire in which the aluminum core wire has a cross-sectional surface area of at least 8 $mm^2$, and the aluminum wire is welded to the core wire welding portion by ultrasonic welding. The wire welded to the terminal is not limited to the thick wire. Instead, in an aluminum wire in which the core wire has a cross-sectional surface area of less than 8 $mm^2$, the aluminum core wire may be welded to the terminal. However, because the thick wire increases the reliability of the electric connection with the terminal, welding is preferred.

Effect of the Invention

As described above, a bolt-fastened terminal connecting to an aluminum wire according to the present invention includes a coating layer plating a wire connection, which is welded to an aluminum core wire of the wire, with a first metal such as nickel, which has a smaller potential difference with respect to aluminum; and forms a coating layer where a surface of an electric contact, which is in contact with a copper or tin plated bolt, base plated with a first metal is plated with a second metal such as tin, which has a smaller potential difference with respect to copper or tin. Accordingly, the occurrence of corrosion, which is likely to develop when the potential difference is large in contact between dissimilar metals, can be prevented or inhibited.

MODE FOR CARRYING OUT THE INVENTION

Figure 1:
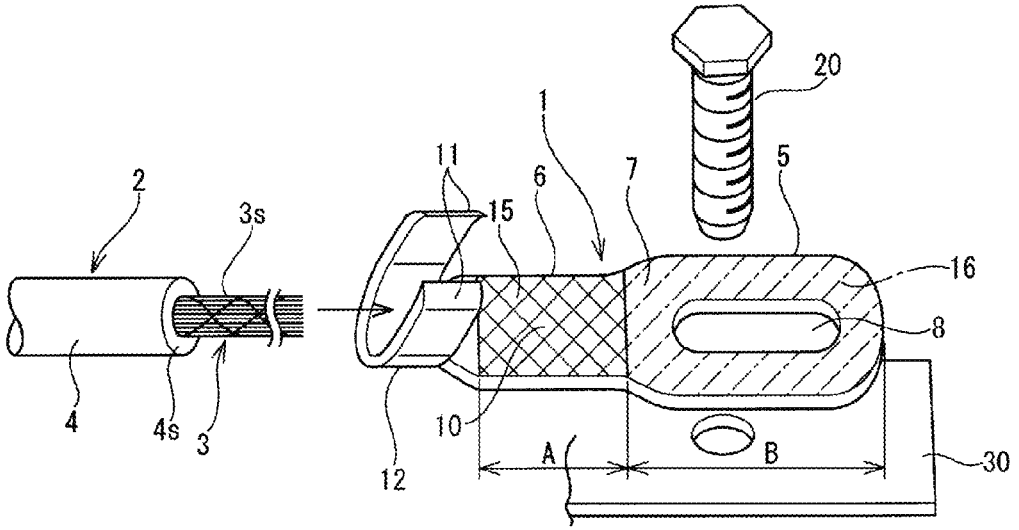
FIG. 1 is a perspective view illustrating a terminal according to a reference embodiment of the present invention.
Figure 2:
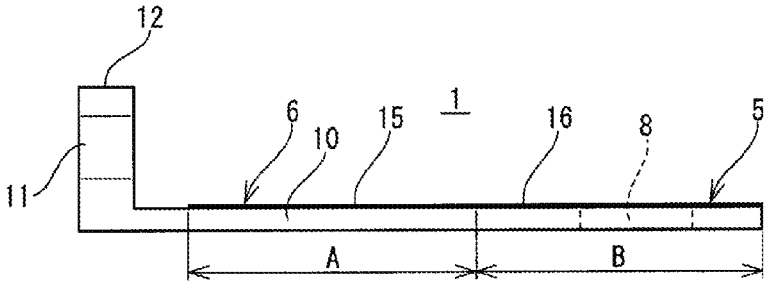
FIG. 2 is a front view of the terminal.

Hereafter, embodiments of the present invention are described with reference to the drawings. FIGS. 1 through 4 illustrate a terminal according to a reference embodiment. The terminal is configured by a bolt-fastened terminal 1 and, as shown in FIG. 1, is connected to a terminal end of an aluminum wire 2 in which aluminum-based metal strands 3*s* are twisted into an aluminum core wire 3, which is coated by an insulating coating 4 configured by an insulating resin. The aluminum wire 2 according to the present reference embodiment is a thick wire in which the aluminum core wire 3 has a cross-sectional surface area of at least 8 $mm^2$, and is routed in an automobile as a power line or a grounding wire.

A front portion of the bolt-fastened terminal 1 includes an electric contact 5, and a rear portion of the bolt-fastened terminal 1 includes a wire connection 6. Specifically, a front portion of a base plate 7, which extends in a front/back direction, has a broad width and forms the electric contact 5, which includes a bolt hole 8. The wire connection 6 includes a core wire welding portion 10 configured by a flat, rectangular plate portion of the continuous base plate 7; and an insulation-coated fastener 12 in which a pair of insulating coating barrels 11 project from two width direction sides of the base plate 7, which projects rearward beyond the core wire welding portion 10.

Figure 3:
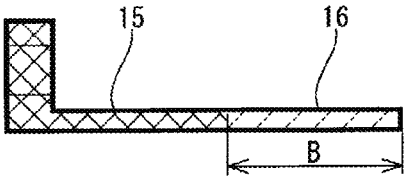
FIG. 3 is a front view showing a modification of the terminal.

The bolt-fastened terminal 1 having the above-noted shape is formed by punching out a copper-based metal plate (brass plate), then bending the plate. An A region on an obverse face of the core wire welding portion 10 of the wire connection 6 has nickel or a nickel alloy (a first metal) plated onto the copper-based metal plate to provide a nickel coating layer 15 (shown by crossed diagonal lines in FIG. 1). Also, as shown in FIG. 3, an entire outer surface of the copper-based metal plate (including a top surface, bottom surface, and two side surfaces of the wire connection 6) may be nickel plated to provide the nickel coating layer 15. In addition, a B region in the drawings on the electric contact 5, to which the bolt 20 is fastened, has tin or a tin alloy (a second metal) plated onto the copper-based metal plate to provide a tin coating layer 16 (shown by a dash-dot line in FIG. 1). Also, as shown in FIG. 3, the entire outer surface of the copper-based metal plate (including the top surface, bottom surface, and side surfaces of the electric contact 5) may be tin plated to provide the tin coating layer 16.

Figure 4:
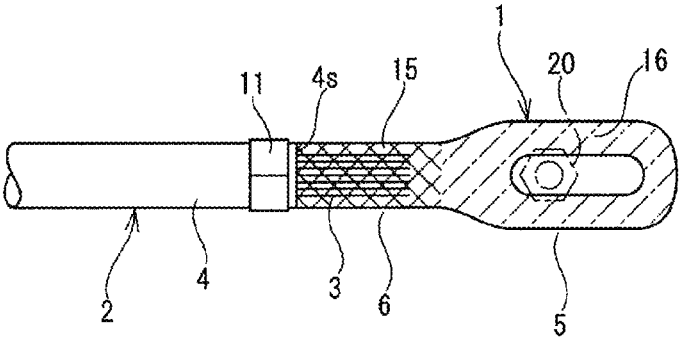
FIG. 4 is a plan view of an aluminum wire connected to the terminal.

As shown in FIG. 4, in connecting the aluminum wire 2 to the bolt-fastened terminal 1, where the aluminum core wire 3 protrudes, exposed, from a stripped end 4*s* of the insulating coating 4, the aluminum core wire 3 is set on the core wire welding portion 10 of the wire connection 6 of the bolt-fastened terminal 1; the stripped end 4*s* is positioned slightly forward of the insulating coating barrels 11; the aluminum core wire 3 is welded to the core wire welding portion 10 in this state using ultrasonic welding; and after welding, the insulating coating barrels 11 are swaged and crimped to an outer circumferential surface of the insulating coating 4.

In a state where the bolt-fastened terminal 1 and the aluminum wire 2 are connected, the aluminum core wire 3 is connected to the nickel coating layer 15 on the obverse face of the core wire welding portion 10. A potential difference between aluminum and nickel is small, where an electric potential of aluminum is −1.662 V and the electric potential of nickel is −0.257 V, and therefore corrosion can be inhibited and prevented from occurring. Furthermore, the aluminum core wire 3 can be welded to the nickel coating layer 15 using ultrasonic welding.

As shown in FIG. 1, the bolt-fastened terminal 1 connected to the aluminum wire 2 is tightened and fixated with the bolt 20 and a conductive member such as a power supply busbar 30. The bolt 20 is formed by a copper-based metal and, in view of corrosion prevention, has tin plating on its surface. The electric contact 5 of the bolt-fastened terminal 1, which is in contact with the tin-plated bolt 20, includes the tin coating layer 16. Therefore, a region where the bolt 20 and the tin coating layer 16 are in contact with each other constitutes contact between similar metals and can therefore prevent corrosion from occurring.

Specifically, the first metal plated onto the wire connection 6 of the bolt-fastened terminal 1 and the second metal plated onto the electric contact 5 are not limited to nickel and tin, as described above. The first metal may be selected from Zn, Cr, Fe, and Ni while the second metal may be selected from Cr, Fe, Ni, and Sn. In addition, the metal selected as the second metal has a smaller negative electric potential and lower ionization tendency than the metal selected as the first metal.

For the first metal, an order from largest negative electric potential and highest ionization tendency to smallest negative electric potential and lowest ionization tendency is: Zn→Cr→Fe→Ni. Similarly, for the first metal, an order from largest negative electric potential and highest ionization tendency to smallest negative electric potential and lowest ionization tendency is: Cr→Fe→Ni→Sn. The second metal plated onto the wire contact 5 is a metal having a smaller negative electric potential than the first metal plated onto the core wire welding portion 10. Therefore, when Zn is selected as the first metal, any of Cr, Fe, Ni, and Sn may be selected as the second metal, but the electric contact 5, which is in contact with the tin-plated-on-copper bolt 20, is preferably tin plated as in the embodiment described above. In contrast, when tin, which has the lowest electric potential, is selected as the second metal plated onto the electric contact 5, the first metal plated onto the core wire welding portion 10 may be any of the Zn, Cr, Fe, and Ni metals described above and is not limited to Ni.

Figure 5:
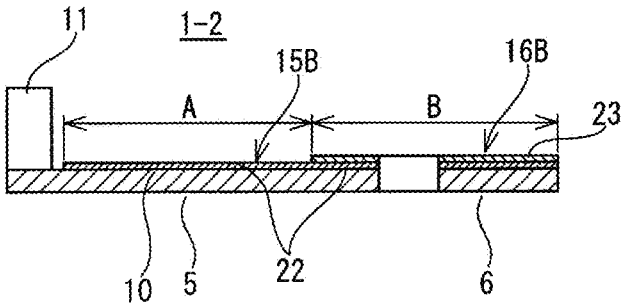
FIG. 5 is a cross-sectional view of a terminal according to an embodiment of the present invention.

In an embodiment of the present invention shown in FIG. 5, nickel plating 22 is applied to an entire bolt-fastened terminal 1-2 as base plating, after which tin plating 23 is applied to the electric contact 5 (excepting the wire connection 6) as top plating, and the electric contact 5 includes a tin coating layer 16B, in which the tin plating 23 is top plated on an obverse face of the base plating nickel plating 22 on an obverse face of the copper-based metal plate. Meanwhile, in the core wire welding portion 10 of the wire connection 6, the base plating nickel plating 22 forms a surface layer nickel coating layer 15B. Other configurations are similar to those of the reference embodiment above, and so descriptions thereof are omitted.

On the bolt-fastened terminal having a copper-based metal plate as a substrate, the plating configured by the first metal and the plating configured by the second metal may be plated prior to punching out the copper-based metal plate; plated in a developed state after punching out and prior to bending; or plated after bending and forming into a product shape. The plating may be either of dip plating (immersing in a plating bath) or a plating method in which a plating liquid is jet-sprayed. Moreover, two-tone plating is preferred in which plating is performed by masking a pre-plated portion.

Figure 6:
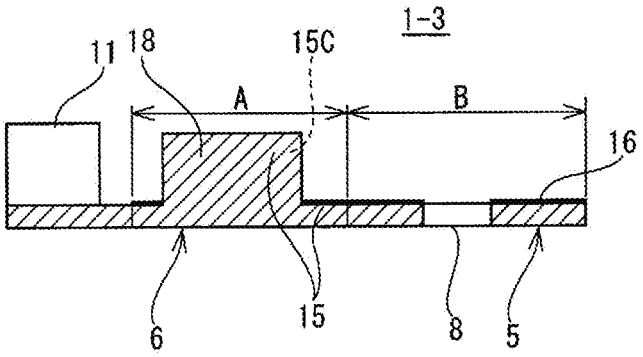
FIG. 6 is a schematic cross-sectional view of a terminal according to another reference embodiment.
Figure 7:
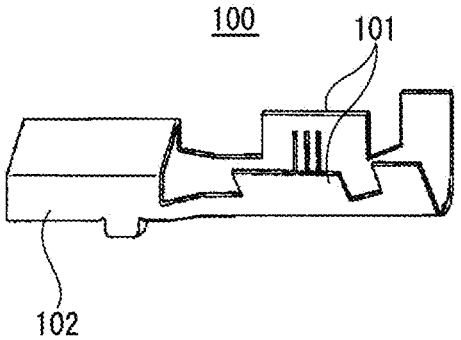
FIG. 7 is a perspective view of a terminal according to a conventional example.
Figure 8:
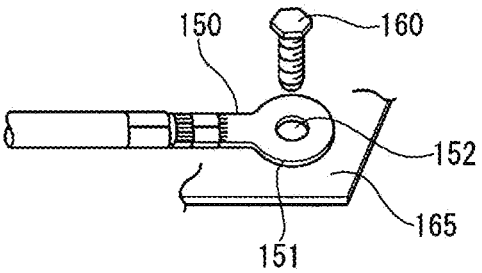
FIG. 8 is a perspective view of another conventional example.

FIG. 6 illustrates another reference embodiment. A bolt-fastened terminal 1-3 according to this reference embodiment has a configuration similar to that of the reference embodiment described above, the bolt-fastened terminal 1-3 providing the nickel coating layer 15 on the core wire welding portion 10 of the wire connection 6 and providing the tin coating layer 16 on the electric contact 5. A pair of core wire barrels 18 are provided projecting from two width direction sides of the core wire welding portion 10 of the wire connection 6, and a nickel coating layer 15C is also provided to an inner surface of the core wire barrels 18, which contacts the aluminum core wire 3. Ultrasonic welding is performed on the core wire barrels 18, after which the core wire barrels 18 are swaged and crimped together with the insulating coating barrels 11.

DESCRIPTION OF REFERENCE NUMERALS

1 Bolt-fastened terminal
2 Aluminum wire
3 Aluminum core wire
4 Insulating coating
5 Electric contact
6 Wire connection
7 Base plate
8 Bolt hole
10 Core wire welding portion
11 Insulating coating barrel
15 Nickel coating layer
16 Tin coating layer
20 Bolt

The invention claimed is:

1. A bolt-fastened terminal connecting to a wire that includes an aluminum core wire of an aluminum-based metal, wherein the terminal includes a wire connection portion configured by a copper-based metal material and continuous with an electric contact portion that includes a bolt hole, the wire connection portion being welded and electrically connected to the aluminum core wire, a surface of the electric contact portion and a surface of the wire connection portion are coated with a first metal and a surface of the first metal of the electric contact portion is coated with a second metal, and the first metal and the second metal, which are configured by different metals, are selected from metals between hydrogen and aluminum, aluminum having a negative electric potential with reference to the electric potential of hydrogen and a high ionization tendency, and the second metal is a metal having a smaller negative electric potential and lower ionization tendency than the first metal.

2. The terminal according to claim 1, wherein the first metal is selected from Zn, Cr, Fe, and Ni while the second metal is selected from Cr, Fe, Ni, and Sn.

3. The terminal according to claim 1, wherein the wire connection portion in contact with the aluminum core wire is coated with nickel or nickel alloy plating, and the electric contact portion in contact with a tin plated bolt is coated with tin or tin alloy plating.

4. The terminal according to claim 1, wherein the terminal is a bolt-fastened terminal having a bolt hole in the electric contact portion, and the wire connection portion in contact with the aluminum core wire has a base plate surface of the wire connection portion, which is continuous with the base plate of the electric contact portion, as a core wire welding portion, and includes an insulating coating barrel at a rear end of the core wire welding portion, the insulating coating barrel being swaged and fixated to an insulating coating of the wire.

5. An aluminum wire connection structure of a terminal wherein the terminal according to claim 1 is connected to the aluminum wire, which is routed in a vehicle and includes the aluminum core wire, and the aluminum wire is a thick wire in which the aluminum core wire has a cross-sectional surface area of at least 8 $mm^2$, and the aluminum wire is welded to the wire connection portion by ultrasonic welding.

* * * * *